US006649564B1

(12) United States Patent
Abe et al.

(10) Patent No.: US 6,649,564 B1
(45) Date of Patent: Nov. 18, 2003

(54) INFORMATION RECORDING SHEET AND METHOD OF MANUFACTURING INFORMATION RECORDING SHEET

(75) Inventors: Tetsuya Abe, Tokyo (JP); Takashi Nozawa, Tokyo (JP); Osamu Kawamura, Osaka (JP)

(73) Assignee: Sony Chemicals Corp., Tokyo (JP)

( * ) Notice: Subject to any disclaimer, the term of this patent is extended or adjusted under 35 U.S.C. 154(b) by 0 days.

(21) Appl. No.: 09/697,786

(22) Filed: Oct. 26, 2000

(30) Foreign Application Priority Data

Oct. 26, 1999 (JP) ..... 11-304635

(51) Int. Cl.[7] ..... B41M 5/035; B41M 5/38

(52) U.S. Cl. ..... 503/227; 427/152; 503/201; 503/204

(58) Field of Search ..... 8/471; 427/152; 503/200, 201, 226, 227, 204

(56) References Cited

U.S. PATENT DOCUMENTS 6,313,067 B1 * 11/2001 Maruyama ..... 503/227

FOREIGN PATENT DOCUMENTS

JP 6-155903 6/1994

* cited by examiner

*Primary Examiner*—B. Hamilton Hess
(74) *Attorney, Agent, or Firm*—Rosenthal & Osha L.L.P.

(57) ABSTRACT

An information recording sheet of the present invention includes a substrate sheet, a variable information recording layer formed on the substrate sheet and a fixed information recording layer formed on a part of the variable information recording layer and made of a subliming dye receptor layer.

3 Claims, 4 Drawing Sheets

INFORMATION RECORDING SHEET AND METHOD OF MANUFACTURING INFORMATION RECORDING SHEET

BACKGROUND OF THE INVENTION

1. Field of the Invention

The present invention relates to an information recording sheet, in particular to an information recording sheet on which a full-color image such as a face photograph can be fixed and formed and different kinds of information is rewritable.

2. Related Background Art

Recently, attentions in various card fields are focused on an information recording sheet on which a full-color image such as a face photograph can be formed and information is rewritable, that is, an information recording sheet having both regions for a fixed information recording layer and a variable information recording layer on a substrate sheet.

As one example of various variable information recording layers, a reversible heat sensitive recording layer is known which includes an electron donor color compound (coupler) and an electron acceptor compound (developer) as critical components. The reversible heat sensitive recording layer includes a function for generating a color recording condition by heating/melting and then cooling down quickly and a non-color condition where a record is lost by heating/melting and then cooling down slowly.

On the other hand, there are various methods for recording fixed information such as the electrophotograph method, ink-jet method, and thermal transfer method. Among those methods, the thermal transfer method is receiving attentions because of its advantages including easy operation and maintenance, smaller device and low cost, reasonable running costs, and less noise. Among various thermal transfer methods, the subliming thermal transfer method is known which uses a subliming dye as a color material and a thermal head for generating heat in accordance with a write signal in order to transfer the color material on a thermal transfer image receiving sheet. This recording method uses a dye as a color material so as to obtain a density gray scale. Thus, it can produce an extremely fine image and excellent color reproducibility in middle tone and gray scale reproducibility, which allow forming a comparable image in quality to a silver halide photograph.

As an information recording sheet including a variable information recording layer and a fixed information recording layer as above, Japanese Patent Laid-Open No. 155903/94 discloses an information recording medium. In the information recording medium in the Japanese Patent Laid-Open No. 155903/94, a reversible heat sensitive recording layer (variable information recording layer) and a transfer receptor layer (fixed information recording layer) are formed on a supporting body.

According to the subliming thermal transfer method, a fixed image is formed by placing a subliming dye acceptor layer of a thermal transfer image receiving sheet over a thermal transfer body (thermal transfer ribbon) having ink layers including a subliming dye layer of three colors (yellow, magenta and cyan), four colors (yellow, magenta, cyan and black) or five colors (yellow, magenta, cyan, black and over-laminate), and applying heat to the thermal transfer body by using a thermal head generating heat in accordance with a write signal so that the subliming dye in the ink layers sublimes and transfer on the dye receptor layer.

SUMMARY OF THE INVENTION

However, the information recording sheet in the publication has problems as follows: The publication discloses an information recording sheet forming a fixed information recording layer and a variable information recording layer on an identical surface of a substrate sheet. However, in the information recording sheet, the fixed information recording layer and the variable information recording layer are aligned in parallel on the identical surface of the substrate sheet. Therefore, when a card is manufactured, occupying areas of the fixed information recording layer and the variable information recording layer are determined in detail in advance. Here, special cares are required for forming each of the layers, which makes production of each layer difficult.

Further, it was difficult to eliminate a space between the fixed information recording layer and the variable information recording layer on an identical place in a recording card of a type that the fixed information recording layer and the variable information recording layer are aligned in parallel as in the conventional one. When a space is caused between each layer, the appearance of the information recording card is bad.

The present invention was made in order to overcome the problem. An object of the present invention is to provide an information recording sheet and a method of manufacturing the same, which looks good and allows easy manufacturing.

In order to achieve the object, the present invention is an information recording sheet including a substrate sheet, a variable information recording layer formed on the substrate sheet and a fixed information recording layer formed on a part of the variable information recording layer and made of a subliming dye receptor layer.

According to the information recording sheet of the present invention, a variable information recording layer is formed on a part or all of at least one surface of a substrate sheet without any care for its dimension and then a fixed information recording layer made of a subliming dye receptor layer is formed, which allows easier manufacturing. Further, an arrangement is adopted where a fixed information recording layer is stacked on the variable information recording layer. Therefore, a space is eliminated between each layer on a place of the information recording card, which makes it good looking.

Furthermore, in the information recording sheet of the present invention, the variable information recording layer is preferably a reversible heat sensitive recording layer.

Still further, in this case, information is preferably stored on the fixed information recording layer and the variable information recording layer, respectively; and thermal processing may be performed on a surface of the fixed information recording layer.

Information such as a letter or a figure is recorded on the reversible heat sensitive recording layer by heating it. However, the layer is turned to the coupler's color during heating. If the information recording sheet remains in the coupler's color, a user can not produce a desired color. Thus, as in the present invention, when thermal processing is performed on the surface of the information recording sheet, which receives a subliming dye and on which information is recorded, the coupler's color can be removed thereby.

A method of manufacturing an information recording sheet according to the present invention includes the steps of forming a variable information recording layer on a substrate sheet and forming a fixed information recording layer made of a subliming dye receptor layer on a part of the variable information recording layer.

According to the method of manufacturing an information recording sheet of the present invention, a variable information recording layer is formed on a part or all of at least one surface of a substrate sheet without any care about its dimension and then a fixed information recording layer made of a subliming dye receptor layer is formed, which allows easier manufacturing. Further, an arrangement is adopted where a fixed information recording layer is stacked on the variable information recording layer. Therefore, a space is eliminated between each layer on a place of the information recording card, which makes it good looking.

DESCRIPTION OF THE PREFERRED EMBODIMENTS

Figure 1:
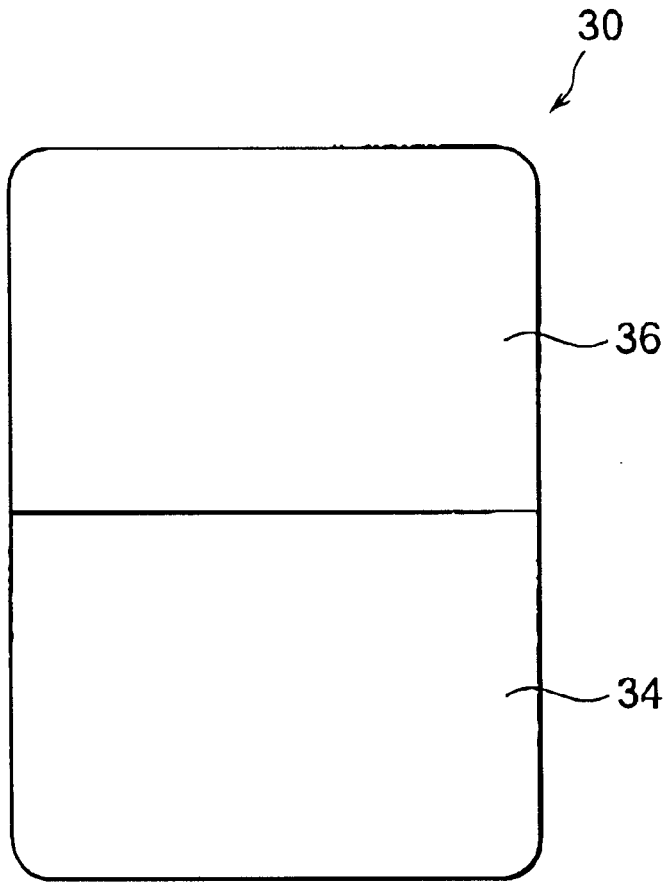
FIG. 1 is a top view of an information recording sheet of the present invention.

A preferred embodiment of an information recording sheet and a method of manufacturing the same according to the present invention will be described in detail with reference to accompanying drawings. Here, identical reference numerals will be given to identical elements, respectively, and repetitive description will be omitted.

Figure 2:
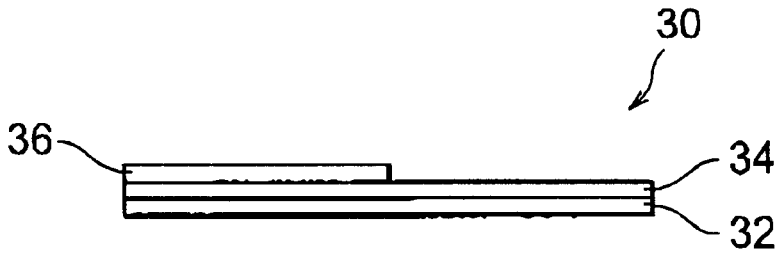
FIG. 2 is an elevation view of the information recording sheet shown in FIG. 1.

FIG. 1 is a top view showing an information recording sheet 30 according this embodiment; and FIG. 2 is an elevation view of the information recording sheet 30 shown in FIG. 1. The information recording sheet 30 includes a substrate sheet 32, a variable information recording layer 34 formed thereon, and a fixed information recording layer 36 formed on the variable information recording layer 34.

A user of the information recording sheet 30 can record different kinds of information on the variable information recording layer 34 and the fixed information recording layer 36 and can rewrite information any number of times on the variable information recording layer 34. Detail descriptions will be given for the substrate sheet 32, the variable information recording layer 34, and the fixed information recording layer 36 below.

[Substrate Sheet]

A substrate sheet 32 for an information recording sheet according to the present invention is not limited in particular and can be selected properly in accordance with applications of the information recording sheet. Its material may be a paper substrate such as bond paper, coated paper, art paper, cast-coated paper, a laminated paper formed by laminating thermoplastic resin such as polyethylene on the paper substrate, a plastic sheet such as polyolefine such as polypropylene, polyester such as polyethylene terephthalate, polystyrene, polyamide, polymethacrylate and polycarbonate, or a composite laminated layer sheet in which two or more kinds of layers are laminated based on a publicly known method such as dry laminating method, wet laminating method and melting laminate method. Among them, polyethylene terephthalate is preferred and especially biaxially-oriented polyethylene terephthalate is suitable.

When a surface of the substrate sheet 32 is made of plastic, surface processing such as oxidation or pebbling or a primer layer is applied to the surface to adhere to the variable information recording layer 34. The oxidation may be corona discharging, chrome acid processing (wet method), flame processing, hot-air processing, or ozone/ultraviolet illuminating processing, for example. The pebbling may be sand-blasting or solvent processing, for example. The surface processing method is selected properly among them in accordance with a type of the substrate sheet. However, in general, the corona discharging is preferably utilized in view of its effects and operability.

The primer used for forming the primer layer is not limited in particular, and a publicly known primer of acryl, polyester, polyurethane, silicon or rubber can be used. In view of durability and adhesion, a primer of acryl or polyester is preferable. The thickness of the primer layer is preferably from 0.1 $\mu$m to 10 $\mu$m in view of uniform coating and adhesion.

Generally, the thickness of the substrate sheet 32 is selected properly from 50 $\mu$m to 800 $\mu$m depending on applications of the information recording sheet.

As the substrate sheet 32 for the information recording sheet according to the present invention, one having specific functions, for example, one having an information recording function already such as a magnetic layer, an optical recording layer and an IC chip may be used.

[Variable Information Recording Layer]

The variable information recording layer 34 of this embodiment is a so-called reversible heat sensitive recording layer.

The reversible heat-sensitive recording layer may be (1) one including a light reflex layer formed by evaporating metal such as aluminum or pasting metal foil such as aluminum foil thereon or a heat sensitive layer made of a thermochromic material, which varies in transparency reversibly through application of heat; or (2) a layer including as a required component an electron donor color compound (coupler) and an electron acceptor compound (developer).

The thermochromic material in the reversible heat sensitive recording layer of (1) nay be one which contains as main components a resinous mother material and an organic low molecular substance distributed therein and varies reversibly in transparency (transparent state, white opaque state) depending on temperature.

Further, the coloring layer and the light reflex layer have a function for making an image formed on the thermochromic material layer clear.

On the other hand, in the reversible heat sensitive recording layer of (2), colors are developed instantly by being heated and the developed colors can be maintained stably also at normal temperature. The colors can be lost by being heated at the color developing temperature or lower, and the non-color state is maintained stably also at normal temperature.

A coupler used in the reversible heat sensitive recording layer of (2) is a non-colored or lightly-colored dye antecedent exhibiting the electron donor characteristic and may be a publicly known compound such as triphenylmethane phthalide series compound, fluoran series compound, phenothiazine series compound, leucoauramine series compound, and indolino phthalide series compound, but not limited to. On the other hand, the developer is an electron donor compound, and may be organic phosphoric acid, alphabetic carboxylic acid and phenol having 12 or more carbon of alphabetic group, metal salt of mercaptoacetic acid having 10 to 18 carbons of alphabetic group, or alkyl ester of kafe acid having 5 to 8 carbons of alkyl group. In particular, long chain alkyl phosphonic acid, long chain a-hydroxy fatty acid, long chain alkylthiomalic acid or long chain alkylmalonic acid is preferable.

The developer is used 1 to 20 times or preferably 2 to 10 times as much as the coupler.

The reversible heat sensitive recording layer may be formed by coating on a substrate sheet a coating solution prepared by distributing or melting a coupler and developer together with binder resin in water or an organic solvent uniformly. The coating solution may contain, as desired, a disperse agent, surfactant, high molecular cation series conducing agent, inorganic filler, color image stabilizer, antioxidant, ultraviolet absorbent, and a smoothing agent.

The binder resin is not limited in particular and may be hydroxy ethylcellulose, hydroxy propylcellulose, methoxy cellulose, carboxy methyl cellulose, methyl cellulose, cellulose acetate, gelatin, casein, starch, poly acrylic vinyl, polyvinyl pyrrolidone, polyacrylamide, polyvinyl chloride, polyvinyl acetate, polyvinyl chloride acetate copolymer, polystyrene, styrene series copolymer, phenoxy resin, polyester, aromatic polyester, polyurethane, polycarbonate, polyacrylic acid esters, polymethacrylic acids, acrylic acid copolymer, maleic acid copolymer, polyvinyl alcohol, or chlorinated polyvinyc chloride resin, for example, which is publicly known. They may be used independently or in combination of two or more of them.

The organic solution must be volatile and have less influence on human bodies and environments. It is not limited in particular, but a highly volatile organic solvent such as toluene and methyl ethyl ketone mixture is preferable.

A solid concentration of the coating solution is selected from 5 to 30 weight % generally in view of coating.

[Fixed Information Recording Layer]

The fixed information recording layer 36 is a subliming dye receptor layer, which can receive a subliming dye. A coating solution used for the subliming dye receptor layer may be one publicly known as one for forming a subliming dye receptor layer. Resinous components used for the coating solution may include polyvinyl acetal, polyvinyl acetate, resin of polyester such as polyethylene terephthalate and polybutylene terephthalate, polyvinyl chloride, polyvinyl chloride acetate copolymer, resin of acrylate such as polyacryl ester and polymethyl ester, cellulose derivative, polyvinyl alcohol, resin of polystyrene, polyamide, polyether imide, polyethylene oxide, polyvinyl ether, polyacrylonitrile, copolymer of α-olefin and other monomer of vinyl, ionomer resin, epoxy resin, polyurethane. They may be used independently or in combination of two or more of them. Added components used as desired may be preferably a crosslinked solvent and/or a catalyst when a crosslinked resin is used as a resinous component, for example. Further, they may be in general a mold release agent for increasing smoothness of the subliming dye receptor layer and preventing fusion between a thermal transfer image receiving sheet and a thermal transfer body (thermal transfer ribbon, a component for improving light resistance, anti-fading and dyeability, ultraviolet absorbent, optical stabilizer, antioxidant, surface active agent, anti-charging agent, silica, titanium oxide, white inorganic filler such as calcium carbonate, fluorescent dye, plastic agent.

The mold release agent may be silicon oil, fluorine silicon oil, silicon oil series such as denaturated silicon oil such as epoxy denaturation, amine denaturation, alcohol denaturation and polyether denaturation, petroleum series such as liquid paraffin, wax series such as paraffin wax and polyethylene wax.

The component for improving light resistance, anti-fading and dyeability may be copolymer of (metha)acrylamide and other monomer, which can be copolymerized. Concretely, it may be (metha)acrylamide-styrene-(metha)acrylic acid copolymer. Furthermore, it may be esterifide of aromatic polybasic acid, alphatic polybasic acid or alicyclic polybasic acid and alphatic alcohol, alicyclic alcohol or phenol, alphatic urethane compound, and aromatic urethane compound, for example.

The ultraviolet absorbent maybe benzophenone series, benzotriazole series, cyanoacrylate series, salicylate series oroxalic acid anilide series. The optical stabilizer may be hindered amine series compound. However, a low molecular type substance may cause problems such as blocking and/or breeding out. Thus, a high polymer type ultraviolet absorbent or optical stabilizer is preferred.

The antioxidant may be hindered phenol series, phosphorus series or sulfur series.

The organic solution is not limited in particular and is preferably a highly volatile organic solution such as a mixture of toluene and methyl ethyl ketone, for example. A solid portion density in the dye receptor layer forming coating suliution must be selected so that the coating solution can be easily applied, and may be selected from 5 weight % to 30 weight % generally, but not limited to.

In order to form the information recording sheet 30 of this embodiment, the reversible heat sensitive recording layer is preferably formed based on a general method on a part or all of at least one surface of the substrate sheet (roll) first and cut into a desired form. Then, preferably, a subliming dye receptor layer is formed in a desired area on the surface where the reversible heat sensitive recording layer is formed for each of the substrate sheet.

In order to form a reversible heat-sensitive recording layer of (1) on a substrate sheet (roll), a light reflex layer or each kind of coloring layer is preferably formed by evaporating metal such as aluminum on a part or all of at least one surface of the substrate sheet (roll) first, and then a layer made of a thermochromic material is formed thereon. In order to form a reversible heat-sensitive recording layer of (2) on a substrate sheet (roll), as described above, a coating solution is prepared which contains a coupler, a developer, binder resin and other different kinds of addictive as necessary. It is coated on a part or all of at least one surface of the substrate sheet (roll) based on a publicly known coating method such as bar coating method, roll coating method, blade coating method, dye coating method, comma coating method, gravure printing method, screen printing method, and offset printing method. Then, it is air-dried or dried by heat or warm wind to form the reversible heat sensitive layer.

A thickness of the reversible heat sensitive recording layer is selected from 5 μm to 30 μt generally.

A protective layer is provided as desired on the reversible heat sensitive recording layer formed through the steps above. The protective layer is preferably made of rubber of silicon, silicon resin, polysiloxane graft polymer or ionized radiation setting resin, for example, and its thickness may be around 0.1 μm to 5 μm.

When a light reflex layer of (1) and a thermochromic material layer are combined to form the reversible heat sensitive recording layer, a concealing layer is generally formed on an area where a subliming dye receptor layer is formed.

In this way, a substrate sheet (roll) on which a reversible heat sensitive recording layer is formed on a part or all of at least one surface is cut into a desired form such as in postcard size, card size and business card size in accordance with applications of the information recording sheet. Then, a subliming dye receptor layer is formed in the sheet fed manner on a desired area on the reversible heat sensitive recording layer.

The subliming dye receptor layer may be buried into the reversible heat sensitive recording layer through heating press processing so that the surface of the information recording sheet 3 can be flat.

According to the present invention, the subliming dye receptor layer is formed by using a sheet-fed type coating device with a specific structure. The sheet-fed type coating device includes mainly (A) a vertically movable coating member and (B) a horizontally movable substrate sheet securing member to which the substrate sheet is attached removably.

Figure 3:
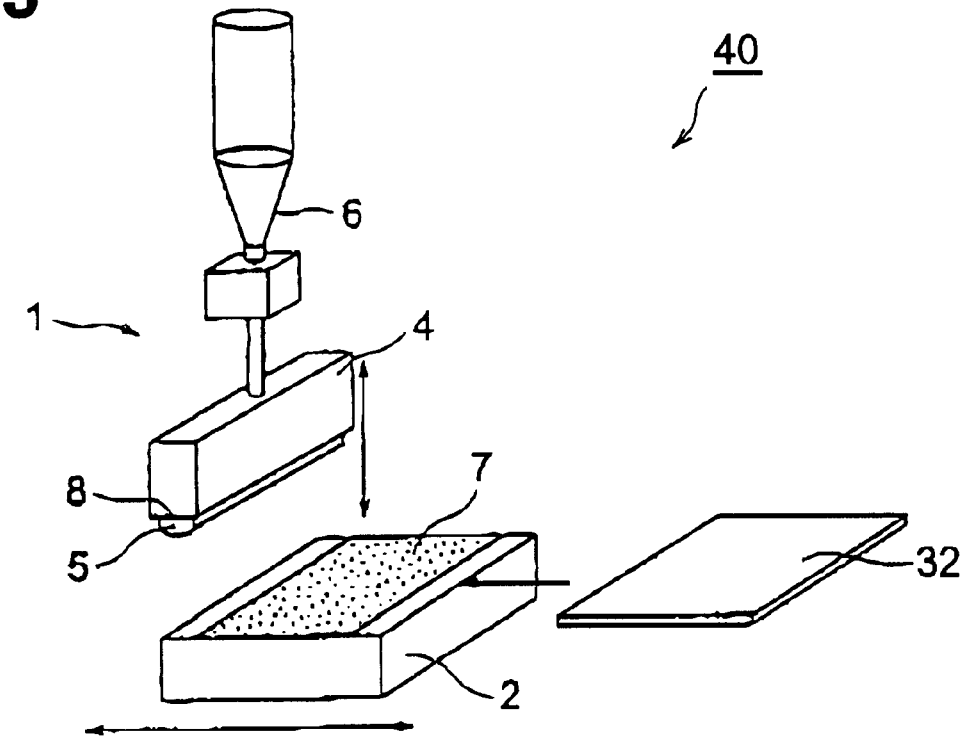
FIG. 3 is a schematic perspective view of one example of a sheet-fed type coating device used for forming a subliming dye receptor layer in an information recording sheet of the present invention.
Figure 4:
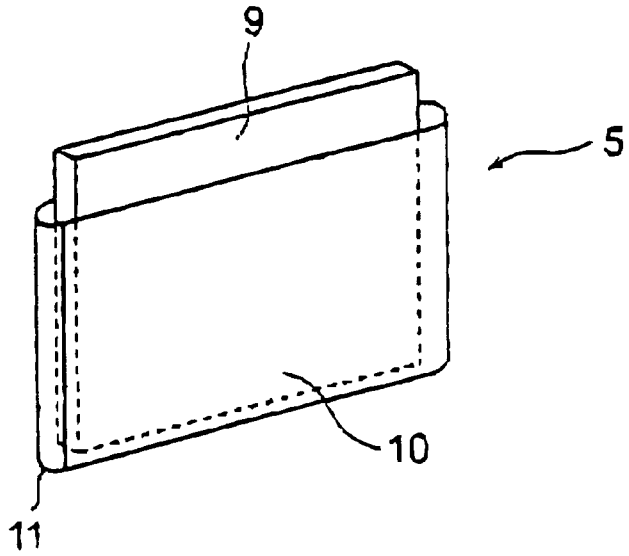
FIG. 4 is a perspective view for showing a structure of one example of a dye receptor layer forming coating solution impregnating member in the coating device in FIG. 1.

FIG. 3 is a schematic perspective view of one example of the sheet fed type coating device used for the present invention. FIG. 4 is a perspective diagram showing a structure of one example of a dye receptor layer forming coating solution impregnating member (simply called coating solution impregnating member hereafter) in the coating device.

As shown in FIG. 3, a coating member 1 in the sheet fed type coating device 40 used in this embodiment includes a box-shaped container 4 having a thin belt-shaped opening 8 on its bottom surface, a coating solution impregnating member 5 accommodated in the container 4 and arranged to project from the opening 8, and dye receptor layer forming coating solution supplying mechanism 6 (simply called coating solution supplying mechanism hereinafter) provided on the box-shaped container 4. The coating member 1 can be moved vertically.

It is important that a dye receptor layer forming coating solution supplied manually or automatically from the coating solution supplying mechanism 6 can be impregnated into the coating solution impregnating member 5 and the coating solution impregnating member 5 can be applied well on a surface of the variable information recording layer 34 in contact with its bottom side surface. Thus, preferably, the coating solution impregnating member 5 is wrapped by a coating solution impregnating laminated layer material 10 made of felt inside and of nonwoven cloth outside around a supporting body 9 made of a metallic plate body such as an aluminum plate, as shown in FIG. 4, for example. The coating solution impregnating member 5 is accommodated in the box-shaped container 4, and a bottom surface 11 of the coating solution impregnating member 5 is arranged so as to project from the opening 8.

The felt and nonwoven materials only need tolerance against the coating solution without any limitation in particular and may be made of different kinds of fiber.

The box-shaped container 4 having the thin belt-shaped opening 8 on its bottom surface is preferably of aluminum or aluminum alloy in view of light weight, corrosion resistance, easy processing, and mechanical characteristics. A shape and a size of the opening 8 is determined properly in accordance with a shape and a size of a subliming dye receptor layer to be formed on a surface of a substrate sheet 32.

On the other hand, a substrate sheet securing member 2 in the sheet-fed type coating device 40 used in this embodiment conveys a to-be-coated substrate sheet 32 immediately under the coating member 1 in order to mount the to-be-coated substrate sheet 32 to be sent from a to-be-coated substrate sheet supplying mechanism, not shown, to a top surface 7 so that a dye receptor layer forming coating solution is coated over its surface. Further, the substrate sheet securing member 2 conveys the coated substrate sheet 32 to a storage, not shown. Furthermore, the substrate sheet securing member 2 can move horizontally to which the substrate sheet is attached removably. Here, the variable information recording layer 34 is formed in advance on the coated substrate sheet 32 sent out from the coated substrate sheet supplying mechanism by the above-described method.

preferably, the to-be-coated substrate sheet 32 is absorbed and secured on the top surface 7 of the substrate sheet securing member 2 by decompressing the substrate sheet securing member 2. In this case, the coated substrate sheet 32 may be conveyed and stored to the storage by changing the pressure of the securing member 2 back to the usual and removing the coated substrate sheet 32 from the securing member 2.

One to-be-coated substrate sheet 32 may be mounted on the top surface of the substrate sheet securing member 2. Alternatively, a plurality of to-be-coated substrate sheets 32 may be mounted at proper intervals on the top surface 7 of the substrate securing member 2.

The substrate sheet securing member 2 may be made of a porous material such as sintered metal, but not limited to.

According to this embodiment, the coating solution impregnating member accommodated in the box-shaped container in the sheet-fed type coating device 40 is supplied and impregnated manually or automatically through the coating solution supplying mechanism where the dye receptor layer forming coating solution is provided on the top surface of the container. Then, the bottom surface of the coating solution impregnated material 5 to which the dye receptor layer forming coating solution was impregnated is made contact with a desired area on the reversible heat sensitive recording layer in order to form a coated layer.

The bottom surface of the coating solution impregnated material 5 may be made contact with the surface of the reversible information recording layer 34 as follows; First of all, one or a plurality of properly spaced to-be-coated substrate sheet(s) 3 sent out from the to-be-coated substrate sheet supplying mechanism is/are absorbed and secured with the coated surface upward on the top surface of the substrate sheet securing member 2 by decompression, for example. Next, the substrate sheet securing member 2 is moved horizontally in order to convey the substrate sheet 3 to the coating member. Then, the coating member is moved down when the substrate sheet 3 to be coated comes to a predetermined position at the bottom of the coating solution impregnating member provided in the opening at the bottom surface of the box-shaped container of the coating member. The bottom surface of the coating solution impregnating member is kept contact with the surface of the reversible information recording layer 34, and the substrate sheet securing member 2 is continuously moved in the horizontal direction in order to coat the dye receptor layer forming coating solution. After coating the substrate sheet, the coating member is moved upward. When the plurality of to-be-coated substrate sheets are secured, the operation is repeated for each to-be-coated substrate sheet. After the substrate sheet securing member is moved with the to-be-coated substrate sheet secured, the pressure of the substrate sheet securing member is changed back to the usual. Then, the coated substrate sheet is removed and stored into the storage.

In this way, the substrate sheet 32 where the dye receptor layer forming coating solution is coated is dried in air or by heat or warm wind in order to form a subliming dye receptor layer in a desired area. A thickness of the receptor layer may be selected from 0.5 μm to 20 μm generally.

Accordingly, the information recording sheet of the present invention can be obtained efficiently which has a subliming dye receptor layer and a reversible heat sensitive recording layer, that is, a variable information recording layer 34 and a fixed information recording layer 36 formed on the variable information recording layer 34 on at least one identical surface of a substrate sheet 32. Using the sheet-fed type coating device 40 raises the productivity significantly without drying the coating solution between printing operations due to discontinuity of printing, which causes problems such as screen clogging or sticky threads of the coating solution on the roll surface as in the case where the screen printing method or the offset printing method is used.

Especially, according to this embodiment, the variable information recording layer 34 is formed on a part or all of at least one surface of a substrate sheet 32 without so any care for its dimensions and then the fixed information recording layer 36 made of a subliming dye receptor layer is formed, which allows extremely easier manufacturing than the case where each of layers is aligned on the substrate sheet in parallel.

Further, an arrangement is adopted where the fixed information recording layer 36 is stacked on the variable information recording layer 34. Therefore, a space is eliminated between the variable information recording layer 34 and the fixed information recording layer 36 on a place of the information recording card 3, which makes it good looking.

Figure 5:
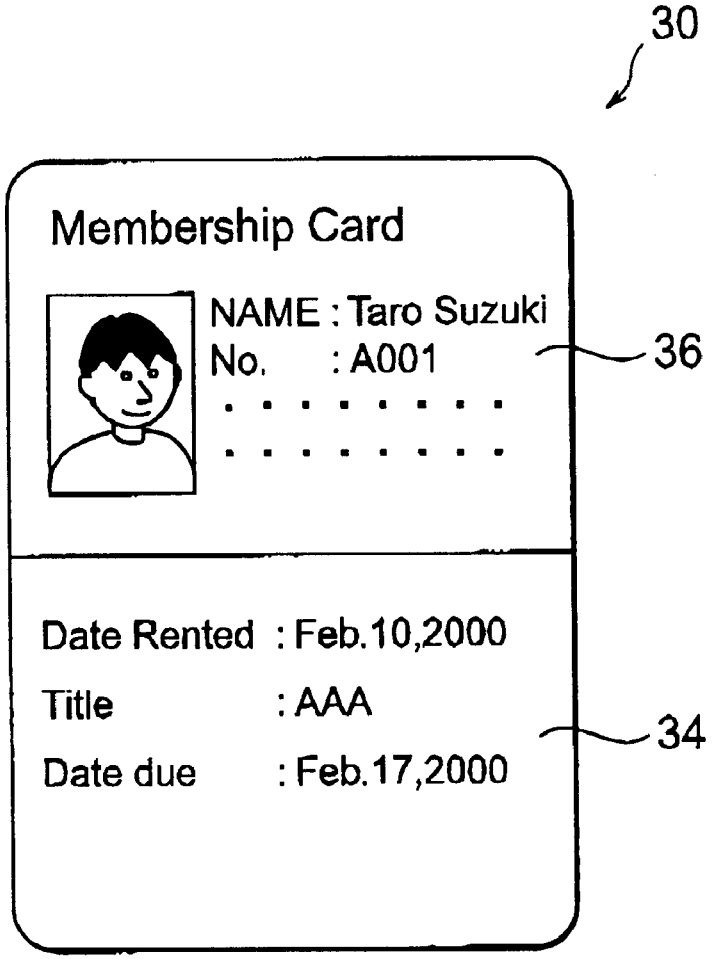
FIG. 5 is a diagram showing a state where fixed information and variable information are recorded on an information recording sheet.

Next, one example of an application of the information recording sheet 30 according to this embodiment will be described with reference to FIG. 5.

Here, description will be given to a case where the information recording sheet 30 is used as a membership card by a video rental shop. As shown in FIG. 5, a face photograph of a member and his/her name and member ship number are recorded on the fixed information recording layer 36 as fixed information.

In order to form such fixed information on the fixed information recording layer 36, a thermal transfer body (thermal transfer ribbon) having an ink layer including a subliming dye layer of three colors (yellow, magenta, cyan) of four colors (yellow, magenta, cyan, black) or of five colors (yellow, magenta, cyan, black, over-laminate) is overlaid upon the fixed information recording layer 36 (subliming dye receptor layer) of the information recording sheet 30. Heat is applied to the thermal transfer body with the thermal head, which generates heat in accordance with a write signal. Then, the subliming dyes of the ink layer are sublimed and transferred onto the dye receptor layer. As a result, a fixed image as shown in FIG. 5 can be formed on the fixed information recording layer 36.

Preferably, the subliming dye used in the ink layer of the thermal transfer body sublimes at 60° C. or above and may be C. I. disperse yellow 1, 3, 8, 9, 16, 41, 54, 60, 77 or 116, C. I disperse red 1, 4, 6, 11, 15, 17, 55, 59, 60, 73 or 83, C. I. disperse blue 3, 14, 19, 26, 56, 60, 64, 72, 99 or 108, C. I. solvent yellow 77 or 176, C. I solvent red 23, 25 or 27, and C. I. solvent blue 36, 63, 83 or 105. Those dyes may be used independently or in combination of two kinds of them.

The ink layer is generally formed by melting or distributing the subliming dyes in the bound resin. A mold release agent may be used in order to prevent it from fusing with a thermal transfer image receiving sheet during thermal transfer recording. The bound resin may be heat plastic resin or thermosetting resin such as, specifically, polyvinyl chloride resin, polyvinyl chloride acetate resin, polyamide, polyethylene, polycarbonate, polystyrene, polypropylene, acrylic resin, phenol resin, polyester, polyurethane, epoxy resin, silicon resin, fluorocarbon polymers, butyl resin, melamine resin, natural rubber, synthetic rubber, polyvinyl alcohol, and cellulose resin. The resin may be used independently or in combination of two kinds of resin. Alternatively, a copolymer of them may be used. Preferably, a thickness of the ink layer is 0.5 μm to 20 μm and especially 1 μm to 10 μm in view of its thermal transfer sensitivity. Further, a concentration of the subliming dye in the ink layer is preferably 5 weight % to 80 weight %, especially 50 weight % to 80 weight % in view of heat sensitivity and better preservation.

The mold release agent may be silicon oil, fluorine silicon oil, silicon oil series such as denaturated silicon oil such as epoxy denaturation, amine denaturation, alcohol denaturation and polyether denaturation, petroleum series such as liquid paraffin, wax series such as paraffin wax and polyethylene wax, for example.

A base body of the thermal transfer body may be generally a film such as condenser paper, polyester film, polystyrene film, polysulfone film, polyimide film and polyaramid film.

A protective layer made of transparent resin may be formed as desired on a surface of a full-color image such as a face photograph formed as above according to a publicly known method.

The information recording card 3 on which fixed information is recorded on the fixed information recording layer 36 can be used as the variable information recording card, on which different kinds of information can be rewritten on the variable information recording layer 34.

Figure 6:
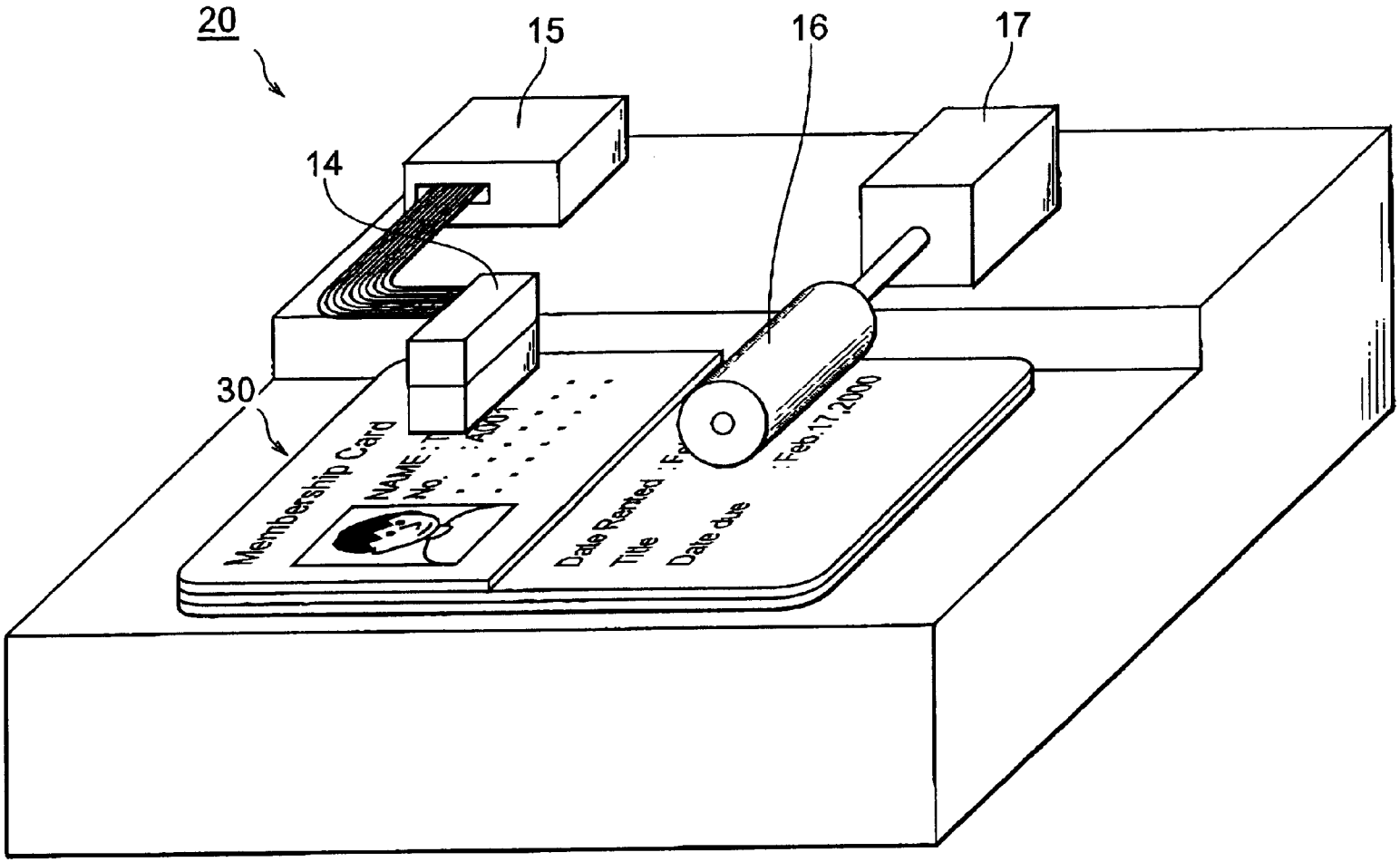
FIG. 6 is a schematic diagram of one example of a device for recording and/or eliminating variable information on the information recording sheet of the present invention.

An information rewriting device 20 as shown schematically in FIG. 6, for example, may be used for recording and/or eliminating information on the variable information recording layer (reversible heat recording layer) 34 of the information recording sheet 30.

The information rewriting device 20 shown in FIG. 6 includes a thermal head 14 controlled by a thermal head drive portion 15 and a heat roll 16 controlled by a heat roll drive portion 17. New information is written into the variable information recording layer 34 through heat processing by the thermal head 14. Thus, as shown in FIG. 3, information such as a rented date, a title of a video tape, its due date can be recorded. The variable information recording layer 34 is heated at a temperature lower than a colored recording temperature by the heat roll 16 so that recorded information can be eliminated.

Information such as letters and/or figures can be recorded on the reversible heat sensitive recording layer through heating by the thermal head 14 as described above. However, the heating often turns the surface of the reversible heat recording layer into the coupler's color. The coupler's is transparent to the fixed information recording layer 36. If the information recording sheet remains in the coupler's color, a user can not produce a desired color. Thus, when information is recorded on the variable information recording layer 34 and the fixed information recording layer 36, respectively, thermal processing is performed on the information recording sheet. As a result, the coupler's color can be removed thereby. Specific method of thermal processing may include a method that the surface of the information recording sheet is traced by an iron stick heated at about 120 to about 140° C. Thus, the unnecessary coupler's color is eliminated, and an information recording sheet with an original color can be obtained

EXAMPLES

Next, the present invention will be described in further detail with reference to examples, though the present invention is not limited to those examples.

First Example

(1) Preparing a Reversible Heat Sensitive Recording Layer Forming Coating Solution Toluene/methyl ethyl ketone mixture (weight ratio 1/1) 79 weight portions, 2-(o-chloroanilide-6-diethylamino fluoran 3 weight portions, octadecyl phosphonic acid 9 weight portions and vinyl chrolide/vinyl chrolide copolymer (Union Carbide, product name: VYHH) 9 weight portions were mixed homogeneously in order to prepare a reversible heat sensitive recording layer forming coating solution.

(2) Preparing a Dye Receptor Layer Forming Coating Solution

Toluene/methyl ethyl ketone mixture (weight ratio 1/1) 400 weight portions, cellulose acetate butylate (Kodak, product name: CAB 500-5) 100 weight portions, diethylisophthalate 20 weight portions, styrene/methacrylic acid/methacrylic amide copolymer (styrene unit 50 weight %, methacrylic acid unit 40 weight %, methacrylic amide unit 10 weight %) 5 weight portions and polyisocyanate (Takeda healthcare Company, product name: Takenate D-ll0N) 5 weight portions were mixed homogeneously in order to prepare a dye receptor layer forming coating solution.

(3) Forming a Reversible Heat Sensitive Recording Layer

Ten card substrates in 85 mm×54 mm and of polyethylene terephthalate for recording information were prepared which had a magnetic layer and a concealing layer thereon on its back surface.

A reversible heat sensitive recording layer forming coating solution obtained in (1) was coated in accordance with the roll-coat method on all over the surface opposite to the concealing layer of each card substrate. It was dried at 80° C. so as to form a 15 μm thick reversible heat sensitive recording layer. Then, it was cut into ten card substrates in 85 mm×54 mm in size.

(4) Forming a Subliming Dye Receptor Layer

The coating solution prepared in (2) was coated in the sheet-fed manner by using the coating device 40 shown in FIG. 3 in a blank area on the reversible heat sensitive recording layer in each of the 10 substrate sheets manufactured in (3) so as to form a subliming dye receptor layer as follows:

First of all, the coating solution prepared in (2) was impregnated into the coating solution impregnating member of the coating member 1 enough. Then, one of the substrate sheets 3 was absorbed and secured by decompression on the upper surface 7 of the substrate sheet securing member 2 with its coating surface upward. Next, the substrate sheet securing member 2 was moved horizontally so as to convey the substrate sheet 3 to the coating member 1. The coating member 1 is moved down when the to-be-coated substrate sheet 3 reached to a predetermined position at the bottom of the coating solution impregnating member 5 of the coating member 1. Then, The substrate sheet securing member 2 was moved continuously in the horizontal direction with keeping the bottom surface of the coating solution impregnating member 5 contact with the reversible heat sensitive recording layer on the to-be-coated substrate sheet 3 so as to coat the dye receptor layer forming coating solution is coated thereon. After the substrate sheet was coated, the coating member 1 is moved upward and then the substrate sheet securing member 2 was moved to a predetermined position with the to-be-coated substrate sheet 3 secured. Then, the pressure of the substrate sheet securing member 2 was changed back to the usual so as to remove the coated substrate sheet 3.

The same coating processes as above were performed on the remaining nine substrates.

Next, each of the coated substrate sheets was dried at 80° C. in order to form a subliming dye receptor layer. Thus, the information recording sheet was manufactured.

As a result, a 2 μm thick, uniform and flat subliming dye receptor layer was formed in a predetermined area on the reversible heat sensitive recording layer in each card substrate. Substantially no variation was recognized in each of the card substrates.

Next, heating press processing was performed on the subliming dye receptor layer, which was then buried into the reversible heat sensitive recording layer. As a result, the surface of the card substrate was flattened, and an information recording magnetic substrate was manufactured.

(5) Forming an Image by Subliming and Transferring

A subliming type card printer (Nisca Corp., product name: PR-5200) was used to print a face photograph pattern based on image data on the subliming dye receptor layer of the ten information recording magnetic card substrates manufactured in (4) so as to manufacture a magnetic card including a face photograph. The face photograph pattern was good in image quality, which was comparable to the general color photograph.

In this way, available information recording magnetic card including a face photograph was manufactured.

(6) Recording and Eliminating Information on the Reversible Heat Sensitive Recording Layer Information was recorded and eliminated repetitively by using the device shown in FIG. 6 on the reversible heat sensitive recording layer in each of the ten variable information recording magnetic card including a face photograph, which was obtained in (5). However, deterioration in performance was not recognized.

First Comparison Example

Ten substrate sheets were manufactured in the same manner as the first example, (1) to (3), each of which was 148 mm×100 mm in size, the postcard size, and had a 15 μm thick reversible heat sensitive recording layer in a rectangular area equivalent to upper half of the whole area with respect to the shorter edge portion.

Then, continuous coating of the coating solution prepared in (2) in the first example was attempted in the sheet-fed manner based on the screen printing method in a blank area on a side having the reversible heat sensitive recording layer in each of the 10 substrate sheets. However, while a well coated layer was formed on the first one, uniformly coated layer could not be obtained on the second and later ones due to screen clogging. Thus, a subliming dye receptor layer, which was practically usable, could not be formed.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An information recording sheet comprising:

a substrate sheet;

a variable information recording layer formed on said substrate sheet, a fixed information recording layer, wherein said variable information recording layer comprises a reversible heat sensitive layer, wherein said fixed information recording layer is made of a subliming dye receptor layer and includes a mold release agent, and said fixed information recording layer is formed on a part of said variable information recording layer; and further wherein thermal processing is performed on a surface of said fixed information layer, and information is stored on said fixed information recording layer and said variable information recording layer, respectively, wherein said fixed information recording layer is buried into said variable information recording layer.

2. A method of manufacturing an information recording sheet comprising, the steps of:

forming a variable information recording layer on a substrate sheet, wherein the variable information recording layer comprises a reversible heat sensitive recording layer;

forming a fixed information recording layer, comprising a subliming dye receptor layer and a mold release agent, on a part of said variable information recording layer; and buying said fixed information recording layer into said variable information recording layer through a heating press process.

3. An information recording sheet, comprising:

a substrate sheet;

a variable information recording layer formed on said substrate sheet wherein said variable information recording layer comprises a reversible heat sensitive layer; and a fixed information recording layer, comprising a subliming dye receptor layer and a mold release agent, wherein the fixed information recording layer is formed on a part of said variable information recording layer; and is buried into said variable information recording layer; and further wherein thermal processing is performed on a surface of said fixed information layer, and information is stored on said fixed information recording layer and said variable information recording layer, respectively.

* * * * *